United States Patent [19]

Lucous

[11] Patent Number: 4,511,037

[45] Date of Patent: Apr. 16, 1985

[54] BOX FOR WRAPPING AND TRANSPORTING FLEXIBLE CORDLIKE STRUCTURE

[76] Inventor: Robert W. Lucous, 1690 S. Shiloh Rd., Laura, Ohio 45337

[21] Appl. No.: 570,931

[22] Filed: Jan. 16, 1984

[51] Int. Cl.[3] ..... B65D 85/67

[52] U.S. Cl. ..... 206/396; 206/397; 206/413; 206/486; 206/303; 229/27

[58] Field of Search ..... 206/396, 397, 413, 414, 206/415, 486, 303; 229/27

[56] References Cited

U.S. PATENT DOCUMENTS

| | | | |
|---|---|---|---|
| 1,889,933 | 12/1932 | Pratt | 206/396 |
| 2,824,641 | 2/1958 | Koenig | 206/396 |
| 2,973,858 | 3/1961 | Laneve et al. | 206/396 |
| 3,401,792 | 9/1968 | Tolaas | 206/396 |
| 4,042,168 | 8/1977 | Kasel et al. | 206/396 |
| 4,159,768 | 7/1979 | Manis et al. | 206/396 |
| 4,298,123 | 11/1981 | Roccaforte et al. | 206/396 |

*Primary Examiner*—Joseph Man-Fu Moy
*Attorney, Agent, or Firm*—James D. Liles

[57] ABSTRACT

A box for transporting and storing flexible cordlike material has a pair of opposing flap panels for closing an either the front or rear opening of an endless enclosure. Each of the flap panels has a pair of opposing L-shaped slits which are foldable in perpendicular relationship to the flap panels to form a core about which the flexible cordlike material may be wound.

6 Claims, 3 Drawing Figures

BOX FOR WRAPPING AND TRANSPORTING FLEXIBLE CORDLIKE STRUCTURE

TECHNICAL FIELD

The present invention relates generally to a box-like structure and more specifically relates to a box-like structure for transporting and storing a flexible cordlike material. The invention will be specifically disclosed in connection with a container designed for transporting and storing a flexible retainer strip assembly of the type used to secure flexible sheet material.

BACKGROUND OF THE INVENTION

Conventionally, six-sided corrogated paperboard containers have been used to transport and store flexible cordlike material. The containers have generally included a centrally disposed internal core structure about which the flexible cordlike material may be wrapped inside the container. Most generally, four sidewalls of the container are designed for radial disposition about the periphery of the wrapped cordlike material. These four sides are formed by two sets of parallel panel sections of corrogated paperboard material joined together in mutually perpendicular relationship at their ends to form an endless enclosure having front and rear openings. The front and rear sides of the container are each formed by four panels hingedly secured to the four peripheral sidewalls. Four of the panels fold into the rear opening to form the rear wall, and the two remaining pairs of panels fold into the front opening to form the front wall.

In a typical prior art six-sided container for transporting and storing flexible cordlike material, the panels extending from opposite sidewalls are folded together with one opposing pair of panels forming an internal set and the other opposing set forming an external set. Each of the opposing internal flaps for the rear side are of generally rectangular configuration and occupy approximately one-half the rear opening area when disposed in perpendicular relationship to the four peripheral sidewalls. Each internal rear flap also has a slotted tab centrally disposed on the interior side of the flap panel opposite the fold line. The slotted tabs extend beyond the interior side of the flap panels, and unless folded out of the plane of the flap panel, overlap the area occupied by the opposing panel. The slotted tabs are each hingedly secured to the internal flap panel along a fold line parallel to the fold line connecting the internal flap panel with the peripheral side panel. With the opposing internal set of flap panels positioned perpendicular to the peripheral side panels, the tabs are bent inwardly 90 degrees with respect to the internal flap panels for disposition in parallel relationship to the peripheral side panels. The external flap panels of the rear side are then folded along fold lines perpendicular to the internal flap panel fold lines connecting the external flap panels to the remaining two peripheral side panels. The external flap panels are positioned in overlying relationship to the internal flap panels and complete closure of the rear openings.

The flap panels for the front opening are very similar to the rear flap panels except that the tabs extending from the internal flap panels do not have a slot and the fold lines for the internal and external flap panels are perpendicular to the corresponding internal and external flap panels on the rear opening. When the front internal flap panels are positioned in perpendicular relationship to the peripheral side panels and the tabs are folded along their fold lines to a position parallel with the peripheral side panels, the tabs of the front flap panels extend through the slots of the tabs in the rear flap panels. The two tabs from the front flap panels are then in criss-cross relationship with the tabs from the rear flap panels. The resulting structure is centrally disposed in the box enclosure and used as a core for wrapping cordlike material.

The requirement for tabs extending beyond the sides of the flap panels in these prior art containers has resulted in paperboard waste, increased cost and inflexibility of use. Most paperboard containers are formed from planar blanks of square or rectangular configuration. The paperboard needed for a blank having a tab panel is necessarily larger than that needed for a similar container without the tabs. This increased size requirement for the paperboard blank increases the cost of the resulting container. Furthermore, much more of the paperboard blank is cut away and wasted. Additionally, stock box blanks, made for other purposes not requiring the tabs, cannot be used for containers of the type discussed above.

Additionally, when the prior art boxes are loaded with material, the front panels are folded to an open position exposing the front opening and removing the front tabs. Thus, the winding core about which the cordlike material is then wound consists of only the two slotted tabs in face to fact abutting relationship.

SUMMARY OF THE INVENTION

Accordingly, it is a primary object of the invention to provide an improved box for storing and transporting flexible cordlike material.

It is another object of the invention to minimize the paperboard stock required to form a box with an internal winding core structure.

It is another object of the invention to provide a box having a centrally disposed winding core which is formable from a paperboard blank cut for a similar box without the winding core structure.

A still further object of the invention is to provide a paperboard box with an integral arcuate winding core for loading flexible cordlike material.

Additional objects, advantages and other novel features of the invention will be set forth in part in the description that follows and in part will become apparent to those skilled in the art upon examination of the following, or may be learned with the practice of the invention. The objects and advantages of the invention may be realized and obtained by means of the instrumentalities and combinations particularly pointed out in the appended claims.

To achieve the foregoing and other objects, and in accordance with the purposes of the present invention as described herein, an improved box is provided for transporting and storing flexible cordlike material. The box includes four sidewalls, all of which are perpendicular to a first predetermined plane. The sidewalls are arranged in end to end relationship to form an endless enclosure with front and rear openings. All of the sidewalls are perpendicular to their adjacent sidewalls. A first flap panel is hingedly secured to one of the sidewalls about a first fold line extending parallel to the first predetermined plane. The first flap panel is foldable into the rear opening for at least partially closing the rear opening when positioned in parallel relationship to the first predetermined plane. A second flap panel is hingedly secured to another of the sidewalls about a second fold line parallel to the first fold line. The second flap panel is also foldable into the rear opening and also at least partially closes the rear opening when positioned in parallel relationship to the first predetermined plane. The first and second fold lines define a second plane which is parallel to the first predetermined plane. A foldable winding core panel is formed in both the first and second flap panels. Winding core panels are formed by opposing L-shaped slits. The L-shaped slits include a first leg extending inwardly toward the fold line from the side of the flap panel opposite the fold line. A second leg of each L-shaped slit extends parallel to the fold lines toward the opposing L-shaped slit. Foldable winding core panels are foldable along core fold lines extending parallel to the first and second fold lines and joining the second legs of the two opposing L-shaped slits. The core panels also include a pair of fold lines extending from the ends of the second legs in a direction perpendicular to the core fold lines.

In accordance with a further aspect of the invention, the box includes third and fourth panels hingedly secured to the remaining sidewalls. The third and fourth panels are foldable about third and fourth fold lines respectively into the front opening to at least partially close the front openings when positioned in parallel relationship to the first predetermined plane. The third and fourth fold lines define a third plane parallel to but spaced from the second plane. Each of the third and fourth flap panels have a pair of opposing L-shaped slits which include a first leg extending inwardly toward the fold line of the flap panel from the side of the flap panel opposite the fold line. A second leg of each L-shaped slit extends parallel to the third and fourth fold lines toward the opposing L-shaped slit in the same flap panel. The L-shaped slits form a core panel foldable along a core fold line extending parallel to the third and fourth fold lines and joining the second legs of the two opposing L-shaped slits. Each of the core panels includes a pair of fold lines extending from the ends of the second legs in a direction perpendicular to the core fold lines.

In a still further aspect of the invention, a pair of rear closure panels are hingedly secured to the sidewalls to which the front flap panels are secured. The rear closure panels are secured to the sidewalls about fold lines perpendicular to the first and second fold lines and are in the second plane. The front closure panels are hingedly secured to the sidewalls to which the rear flap panels are secured. The front closure panels are secured to the sidewalls about fold lines perpendicular to the third and fourth fold lines in the third plane. The closure panels are foldable to a position parallel with the predetermined plane and external to the folded flap panels.

In a specific aspect of the invention, the box is formed of corrogated paperboard.

Preferably, the first leg of the L-shaped slits extends for a distance approximately equal to the width of the sidewalls.

In another aspect of the invention, each of the sidewalls is of a predetermined length, and each of the flap panels extends approximately one half the predetermined length from the respective fold lines with the sidewalls.

Still other objects of the present invention will become readily apparent to those skilled in this art from the following description wherein there is shown and described a preferred embodiment of this invention, simply by way of illustration, of one of the best modes contemplated for carrying out the invention. As will be realized, the invention is capable of other different embodiments, and its several details are capable of modification in various, obvious aspects all without departing from the invention. Accordingly, the drawings and descriptions will be regarded as illustrative in nature and not as restrictive.

BRIEF DESCRIPTION OF THE DRAWINGS

The accompanying drawings incorporated in and forming a part of the specification illustrate several aspects of the present invention, and together with the description serve to explain the principles of the invention. In the drawings.

Reference will now be made in detail to the present preferred embodiment of the invention, an example of which is illustrated in the accompanying drawings.

DETAILED DESCRIPTION OF THE PREFERRED EMBODIMENT

Figure 1:
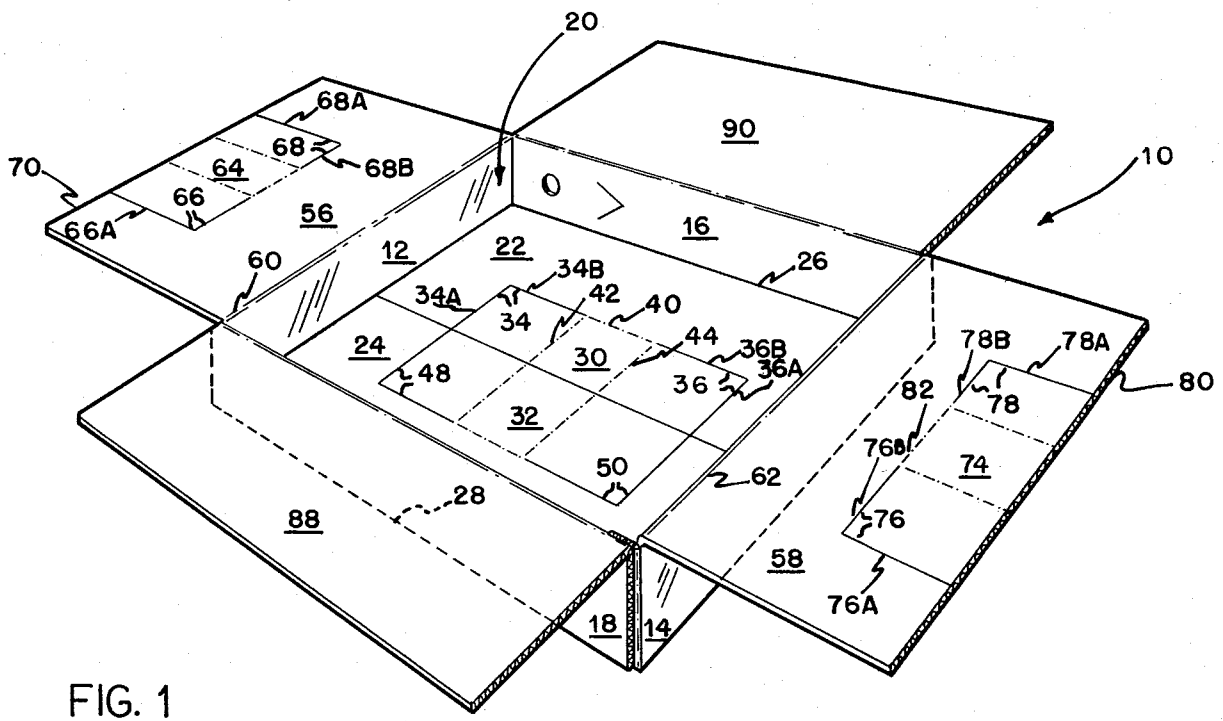
FIG. 1 is a perspective view of a box for transporting and storing flexible cordlike material constructed in accordance with the present invention.

Referring now to the drawings, FIG. 1 shows a box 10 constructed in accordance with the principles of the present invention. The box 10 is preferably formed of corrogated paperboard and includes two pairs of parallel sidewalls 12,14 and 16,18 joined in continuous end to end relationship and forming an endless enclosure having a rear opening (the rear opening is closed in the illustrations) and a front opening 20. The first set of parallel sidewalls 12,14 are perpendicular to the second set 14,16. All four sidewalls 12,14,16,18 are perpendicular to both a first predetermined plane and to each adjacent sidewall.

The rear opening is closable by a pair of flap panels 22 and 24. The first of the flap panels 22 is hingedly secured to the sidewall 16 about a first fold line 26. The second flap panel 24 is hingedly secured to the opposing sidewall 18 about a second fold line 28. The first and second fold lines 26 and 28 define a second plane parallel to the first predetermined plane. As seen in the illustration of FIG. 1, both of the flap panels 22,24 are foldable about their respective fold lines (26 and 28) into positions parallel to the first predetermined plane to at least partially close the rear opening.

Each of the flap panels 22,24 has a winding core panel centrally disposed along their free sides opposite their fold lines, core panel 30 being disposed on flap panel 22, and core panel 32 being disposed on flap panel 24. Each of the core panels are formed by opposing L-shaped slits. For example, core panel 30 is formed by a first L-shaped slit 34 having a first leg **34*a* and a second leg 34*b*. An opposing L-shaped slit 36 of the core panel 30 includes a first leg 36*a* and a second leg 36*b*. The first legs 34*a* and 36*a* of L-shaped slits 34 and 36 respectively extend from the free edge 38 of flap panel 22 toward the first fold line 26. Each of the second L-shaped legs 34*b*, 36*b* extends perpendicular to the first legs 34*a*, 36*a* and parallel to the first fold line 26. The L-shaped slits 34 and 36 are opposing in the sense that the second legs 34***b*, 36*b* extend toward each other.

A core fold line 40, also extending parallel to the first fold line 26, joins the second legs 34*b* and 36*b* to form a hinge connection between core panel 30 and the remaining portions of flap panel 22. As most clearly illustrated in FIG. 2, the core panel 30 also includes a pair of fold lines 42 and 44 which perpendicularly extend from the core fold line 40 to the free edge 38 to permit the core panel 30 to be folded to approximate an arcuate configuration.

Figure 2:
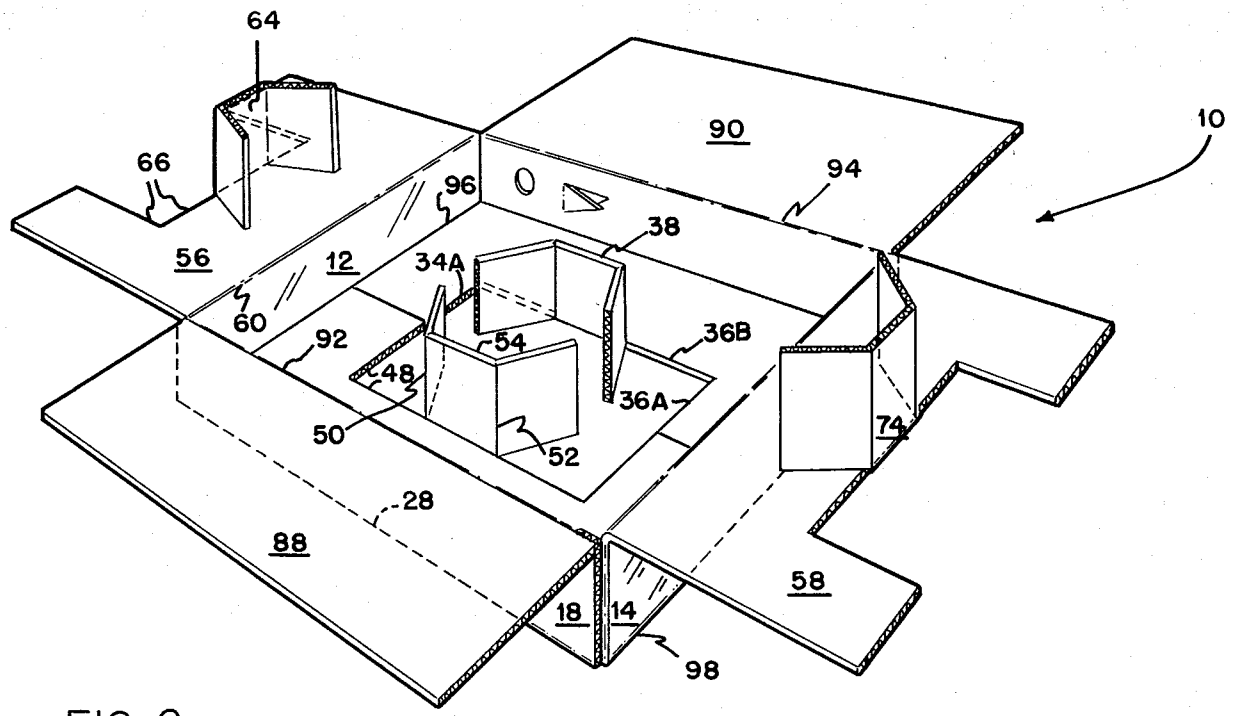
FIG. 2 is a perspective view of the box of FIG. 1 illustrating the core panels folded along their fold lines to form a winding core about which to wrap the cordlike material.

Flap panel 24 is a mirror image of flap panel 22 and includes the winding core panel 32. The core panel 32 similarly includes a pair of opposing L-shaped slits 48 and 50. As also seen in FIG. 2, the core panel 32 is foldable about a core fold line 48 extending parallel to the second fold line 28. A pair of fold lines 50 and 52 extend perpendicularly from the fold line 48 to a free edge 54. When folded about fold lines 50 and 52, as shown in FIG. 2, the core panel 32 approximates an arcuate configuration. The box 10 also includes third and fourth flap panels 56 and 58 foldable into the front opening 20. The third flap panel 56 is hingedly secured to the sidewall 12 about a third fold line 60 while the fourth flap panel 58 is attached to sidewall 14 about a fourth fold line 62. The fold lines 60 and 62 are each perpendicular to the fold lines 26 and 28 and define a third plane, spaced from but parallel to the second plane defined by fold lines 26,28.

The front flap panels 56 and 58 are mirror images of each other and structurally similar to the rear flap panels 22,24. Flap panels 56 includes a winding core panel 64 formed by a pair of opposing L-shaped slits 66 and 68. Like the L-shaped slits of previously described flap panels 22 and 24, the L-shaped slits 66,68 include first legs 66*a*, 68*a* extending from a free edge 70 of the flap panel 56 perpendicularly toward the third fold line 60. Legs 66*b*,68*b* of the same slits extend toward each other in a direction parallel to the third fold line 60 and are joined by a core fold line 72.

Similarly, a core panel 74 in flap panel 58 includes two L-shaped slits 76,78 having first legs 76*a*,78*a*, extending from a free edge 80 toward the fourth fold line 62, and second legs 76*b*,78*b* extending parallel to the fourth fold line 62. The core panel 74 is foldable about a core fold line 82 and parallel fold lines 84,86 to form a core insert of approximate arcuate configuration as illustrated in FIG. 2. When the flap panels 56 and 58 are folded approximately 90 degrees from the FIG. 2 depiction into the front opening 20, the core panels 64 and 74 cooperate to form an internal core structure of generally cylindrical configuration.

Figure 3:
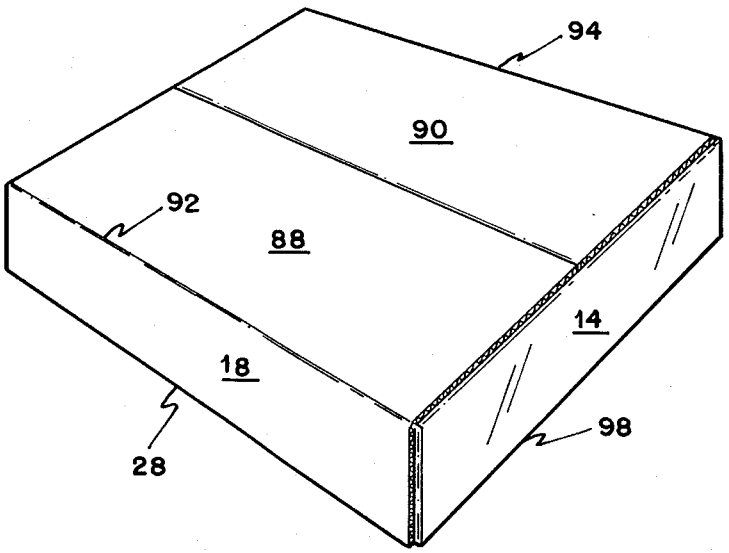
FIG. 3 is a perspective view of a box of FIGS. 1 and 2 with the external flap panels folded to close the box.

The box 10 also includes a pair of closure panels for both the front and rear openings. The front closure panels are secured to sidewalls 18 and 16 respectively about fold lines 92 and 94. The fold lines 92,94 are in approximately the third plane defined by fold lines 60 and 62 but are perpendicular to these last mentioned fold lines. As shown in FIG. 3, the front closure panels 89,90 are foldable about fold lines in external overlapping relationship to flap panels 56 and 58 to close the front opening 20. A pair of rear closure panels attached to sidewalls 12 and 14 about fold lines 96 and 98 close the rear opening by folding in overlapping relationship to rear flap panels 22 and 24 in a similar fashion.

The width of the sidewalls 12,14,16,18 are approximately equal, and the first legs of each of the L-shaped slits are preferably approximately equal to this width. As a result, the winding core structure formed by core panels 30,46,64 and 74 extend through the width of the container 10.

In summary, numerous benefits have been described which result from employing the concepts of the invention. The box has an improved central core structure for winding flexible cordlike material which may be formed from a paperboard blank designed for a similar box without a core structure. The box avoids the paperboard waste and expense necessitated by tab type core structures and provides an integral arcuate winding core.

The foregoing description of a preferred embodiment of the invention has been presented for purposes of illustration and description. It is not intended to be exhaustive or to limit the invention to the precise form disclosed. Obvious modifications or variations are possible in light of the above teachings. The embodiment was chosen and described in order to best illustrate the principles of the invention and its practical application to thereby enable one of ordinary skill in the art to best utilize the invention in various embodiments and with various modifications as are suited to the particular use contemplated. It is intended that the scope of the invention be defined by the claims appended hereto.

I claim:

1. A box for transporting and storing a flexible cordlike material, comprising:

(a) four sidewalls, said sidewalls being perpendicular to a first predetermined plane and arranged in end to end relationship to form an endless enclosure with front and rear openings, each of the sidewalls being perpendicular to adjacent sidewalls;

(b) a first flap panel hingedly secured to one of the sidewalls about a first fold line extending parallel to said first predetermined plane, said first flap panel being foldable into the rear opening and at least partially closing the rear opening when positioned in parallel relationship to said first predetermined plane;

(c) a second flap panel hingedly secured to another of the sidewalls about a second fold line parallel to the first fold line, said second flap panel being foldable into the rear opening and at least partially closing the rear opening when positioned in parallel relationship to said first predetermined plane, said first and second fold lines defining a second plane parallel to the first predetermined plane; and (d) a foldable core panel formed in both the first and second flap panels, each of said core panels being formed by opposing L-shaped slits, each of the L-shaped slits including a first leg extending inwardly toward the corresponding fold line from the side of the flap panel opposite the fold line with a second leg of each L-shaped slit extending parallel to the fold lines toward the opposing L-shaped slit, said foldable core panels being foldable along core fold lines extending parallel to the first and second fold lines and joining the second legs of the two opposing L-shaped slits, said core panels including a pair of fold lines extending from the ends of the second legs in a direction perpendicular to the core fold lines.

2. A box as recited in claim 1 further including third and fourth flap panels hingedly secured to the remaining sidewalls, said third and fourth flap panels being foldable about third and fourth fold lines respectively into the front opening to at least partially close the front opening when positioned in parallel relationship to the first predetermined plane, said third and fourth fold lines defining a third plane parallel to but spaced from the second plane, each of said third and fourth flap panels having a pair of opposing L-shaped slits, each of the L-shaped slits including a first leg extending inwardly toward the fold line of the flap panel from the side of the flap panel opposite the fold line with a second leg of each L-shaped slit extending parallel to the third and fourth fold lines toward the opposing L-shaped slitin the same flap panel, said L-shaped slits forming a core panel foldable along a core fold line extending parallel to the third and fourth fold lines and joining the second legs of the two opposing L-shaped slits, each of said core panels including a pair of fold lines extending from the ends of the second legs in a direction perpendicular to the core fold lines.

3. A box as recited in claim 2 further including a pair of rear closure panels hingedly secured to the sidewalls to which the front flap panels are secured, said rear closure panels being secured to the sidewalls about fold lines perpendicular to the first and second fold lines in the second plane, front closure panels hingedly secured to the sidewalls to which the rear flap panels are secured, said front closure panels being secured to the sidewalls about fold lines perpendicular to the third and fourth fold lines in the third plane, said closure panels being foldable to a position parallel with the predetermined plane and external to the folded flap panels.

4. A box as recited in claim 3 wherein the box is formed of corrogated paperboard.

5. A box as recited in claim 3 wherein the first leg of the L-shaped slits extends for a distance approximately equal to the width of the sidewalls.

6. A box as recited in claim 5 wherein each of the sidewalls is of a predetermined length and each of the flap panels extends approximately one half the predetermined length from their respective fold lines with the sidewalls.

* * * * *